US010682662B2

(12) United States Patent
Grünbeck

(10) Patent No.: US 10,682,662 B2
(45) Date of Patent: Jun. 16, 2020

(54) NOZZLE DEVICE FOR A FOUNTAIN AND FOUNTAIN

(71) Applicant: Manfred Grünbeck, Bad Abbach-Lengfeld (DE)

(72) Inventor: Manfred Grünbeck, Bad Abbach-Lengfeld (DE)

( * ) Notice: Subject to any disclaimer, the term of this patent is extended or adjusted under 35 U.S.C. 154(b) by 72 days.

(21) Appl. No.: 15/801,637

(22) Filed: Nov. 2, 2017

(65) Prior Publication Data

US 2018/0117617 A1 May 3, 2018

(30) Foreign Application Priority Data

Nov. 2, 2016 (DE) ..... 20 2016 006 740 U

(51) Int. Cl.

| | |
|---|---|
| ***B05B 17/08*** | (2006.01) |
| ***B05B 1/20*** | (2006.01) |
| ***B05B 15/65*** | (2018.01) |
| ***B05B 9/04*** | (2006.01) |
| *B67D 1/00* | (2006.01) |

(52) U.S. Cl.

CPC ..... *B05B 17/08* (2013.01); *B05B 1/20* (2013.01); *B05B 1/205* (2013.01); *B05B 9/0403* (2013.01); *B05B 15/65* (2018.02); *B67D 1/0081* (2013.01)

(58) Field of Classification Search

CPC ..... B05B 1/20; B05B 1/205; B05B 1/207; B05B 9/0403; B05B 15/65; B05B 15/652; B05B 15/658; B05B 17/08

See application file for complete search history.

(56) References Cited

U.S. PATENT DOCUMENTS

| | | | | |
|---|---|---|---|---|
| 5,608,927 A * | 3/1997 | Lowry | A47K 3/28 | 239/193 |
| 5,862,984 A * | 1/1999 | Chang | B05B 17/08 | 239/16 |
| 6,000,631 A * | 12/1999 | Lamminen | B60S 3/04 | 134/123 |
| 6,581,855 B1 * | 6/2003 | Cook | A62C 99/0072 | 239/548 |
| 6,592,049 B1 * | 7/2003 | Wolput | B05B 1/202 | 239/70 |

(Continued)

FOREIGN PATENT DOCUMENTS

JP 2002-168486 A 6/2002

OTHER PUBLICATIONS

May 2, 2018 German Office Action issued in German Patent Application No. 10 2017 010 121.3.

*Primary Examiner* — Ryan A Reis

(74) *Attorney, Agent, or Firm* — MH2 Technology Law Group, LLP

(57) ABSTRACT

Nozzle means for directional jetting of a fountain fluid comprising at least one, in particular elongated, nozzle for directed radiation of the fountain fluid, wherein the nozzle has a main extension direction, so that the fountain fluid can be removed substantially parallel to this main extension direction along a main distribution direction, at least one nozzle carrier on which the nozzle is arranged detachably or inseparably, characterized in that the nozzle carrier forms a main extension plane of the nozzle carrier, and wherein at least the main radiation direction of the nozzle leads away from the main extension plane of the nozzle carrier in at least one directional component.

13 Claims, 1 Drawing Sheet

(56) References Cited

U.S. PATENT DOCUMENTS

Figure 1:
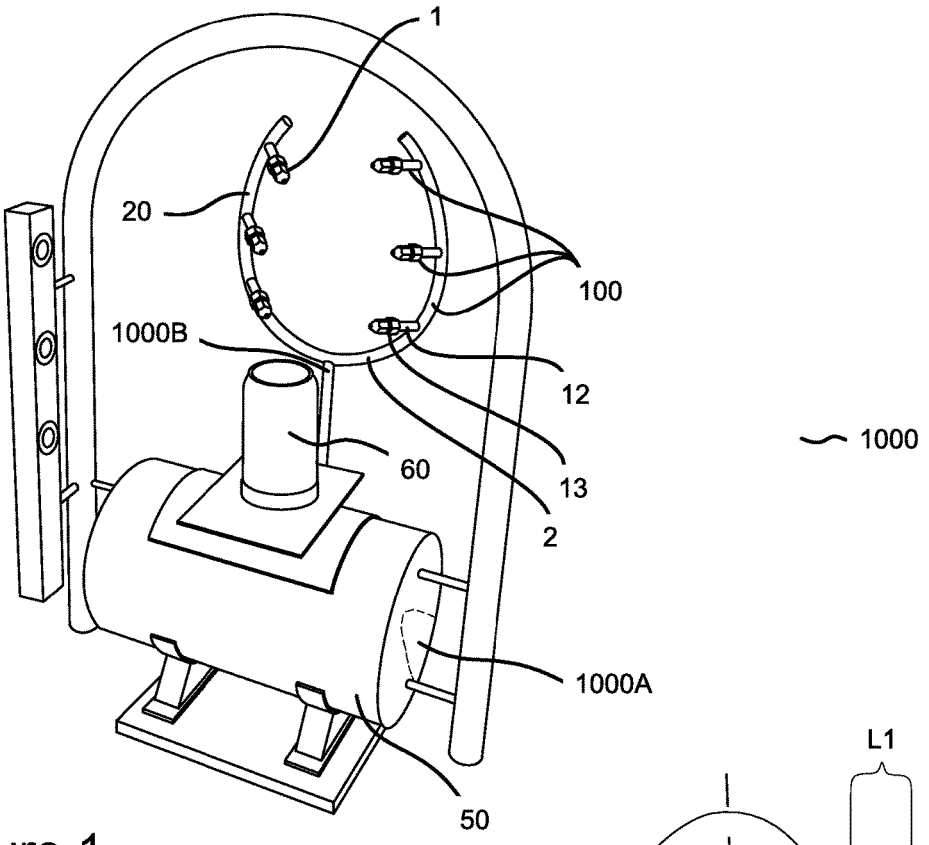

| | | | | |
|---|---|---|---|---|
| 6,607,144 | B1 * | 8/2003 | Yen | B05B 17/08 239/16 |
| 2007/0107121 | A1 * | 5/2007 | Smith | A61M 35/00 4/615 |
| 2013/0015272 | A1 * | 1/2013 | Raab | B05B 1/1618 239/548 |

* cited by examiner

NOZZLE DEVICE FOR A FOUNTAIN AND FOUNTAIN

The present invention concerns a nozzle device for the directed radiation of a fountain fluid as well as a fountain in accordance with the respective general terms of protection claims 1 and 10.

The nozzle arrangement suggested here for the directed jetting of a fountain fluid includes at least one nozzle, in particular an elongated nozzle for the directed radiation of the fountain fluid, the nozzle having a main direction of extension so that the fountain fluid can be removed substantially parallel to this main direction of extension, and at least one nozzle carrier on which the nozzle is mounted detachably or inseparably.

An idea of the present invention is that the nozzle carrier now forms a nozzle carrier main extension plane, whereby at least the main radiation direction of the nozzle in at least one directional component leads away from the nozzle carrier main extension plane.

The nozzle support device can comprise or be a continuous pipeline through which the fountain fluid can be guided. This pipe therefore runs in a continuous plane. In particular, this pipeline can deviate at least in some areas from a constantly straight-line course, so that a pipe routing plane is formed, which can be identical to the main extension plane of the nozzle carrier.

It is therefore particularly remarkable in the present invention that the nozzle carrier device deviates from a pipe which extends only in one dimension and therefore the pipe of the nozzle carrier device extends at least in places into two, preferably exactly two, dimensions in exactly this main direction of the nozzle carrier device.

According to at least one embodiment, the nozzle device proposed here for the directed radiation of a fountain fluid comprises at least one, in particular elongated, nozzle for the directed radiation of the fountain fluid, the nozzle having a main direction of extension, so that the fountain fluid can be removed substantially parallel to this main direction of dispersion, the fountain fluid being movable along a main direction of radiation. In addition, the nozzle equipment described here includes at least one nozzle carrier on which the nozzle is mounted detachably or inseparably.

According to the invention, the nozzle carrier forms a nozzle carrier main extension plane, whereby at least the main radiation direction of the nozzle leads away from the nozzle carrier main extension plane in at least one direction component.

In accordance with at least one embodiment, the main extension direction of the nozzle protrudes in at least one directional component from the nozzle carrier main distribution plane of the nozzle carrier.

According to at least one embodiment, the nozzle carrier is formed by at least one gebogenetic and/or a straight-line fluid line, this fluid line running at least in places in a circular, ellipsoidal manner and/or along at least one pipe edge in the nozzle carrier main extension plane.

According to at least one embodiment, the nozzle carrier is designed as a single piece. For example, the nozzle carrier is made entirely or partly of metal, plastic and/or wood.

According to at least one embodiment, the nozzle comprises a nozzle holder, in particular an elongated nozzle holder, the free end of which can be loosened or inseparably fitted with a nozzle head.

According to at least one embodiment, at least two nozzles spaced apart from each other are arranged along the length of the nozzle carrier.

According to at least one embodiment, there are at least three jets arranged along the course of the nozzle carrier with at least three jets spaced apart from each other at equal or different distances.

According to at least one embodiment, at least one nozzle is inseparable, i. e. not non-destructive, from the nozzle carrier. However, it is also conceivable that at least one nozzle can be detached and thus also replaced, on which the nozzle carrier is mounted.

According to at least one embodiment, the nozzle carrier and the nozzle are each formed with at least one fluid line, so that the fluid can pass through them.

Furthermore, the present invention concerns a fountain, whereby the proposed fountain comprises at least one nozzle device for the directed radiation of a fountain fluid according to at least one of the above mentioned embodiments.

This means that all the characteristics of the described nozzle arrangement, which are revealed in connection with this, are also revealed for the fountain described below and vice versa.

According to at least one embodiment, the fountain proposed here comprises at least one fluid pump for conveying a fluid, at least one pipe for conveying the fluid from a fluid container to and from a nozzle device according to at least one of the above mentioned embodiments, whereby, after passing the fluid through the nozzle device, the fluid after exiting the nozzle, a self-contained fluid circuit is led into at least one collecting container, so that a self-contained fluid circuit is led through the nozzle device, the fluid after exiting the nozzle.

According to at least one embodiment, at least one nozzle, preferably each of the nozzles, is arranged laterally offset relative to a longitudinal direction of the collecting vessel.

According to at least one embodiment, the main jet carrier plane extends substantially parallel to the longitudinal direction of the receiver, the main jet radiating direction of the nozzle protruding from the main jet carrier plane in at least one directional component.

In accordance with at least one embodiment, the collecting container is fixed interchangeably in a container anchorage.

According to at least one embodiment, the container is a beer mug. The fountain fluid (=Fluid) can be beer, juice, water or any other liquid.

According to at least one embodiment, at least one nozzle has such a main radiation direction in which at least one directional component points inwards in the direction of a geometric centre of the nozzle carrier.

According to at least one embodiment, a length and/or the main direction of radiation of the nozzle is dimensioned in such a way that, after discharge from the nozzle, the fluid falls into the collecting vessel located below the nozzle solely by the action of gravity and without ductwork. This can mean in particular that the fluid is in free fall after exiting the nozzle until it hits the collecting tank.

In the following, the invention shown above is explained in more detail by means of an example and the corresponding schematic figures.

Figure 2:
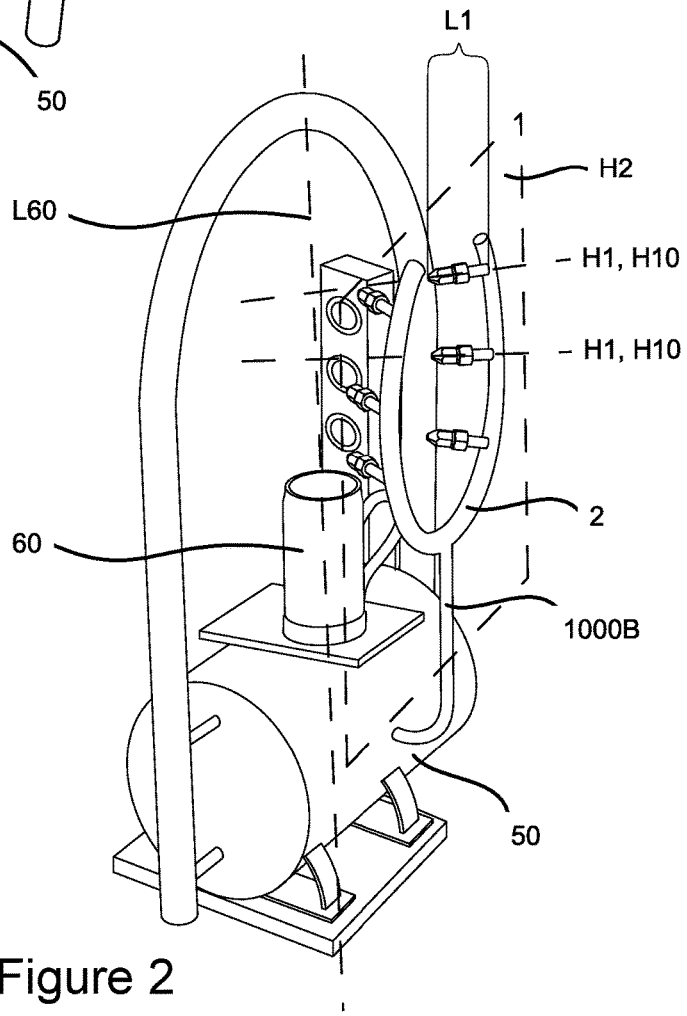

FIGS. 1 and 2 show schematically in perspective an example of a embodiment of a fountain 1000 described here, comprising a nozzle device 100 described here.

In particular, it is evident from the figures that the fountain 1000 comprises at least one fluid pump 1000A for conveying a fluid, at least one pipe 1000B for conveying the fluid from a fluid container 50 to and to a nozzle device 100 in accordance with at least one of the previous embodiments, whereby after passing the fluid through the nozzle device 100, the fluid after leaving the nozzle 1, is led into at least one collecting container 60.

The nozzle device 100 described here comprises several nozzles 1, whereby each of the nozzles 1 are arranged laterally offset relative to a longitudinal direction L60 of the collecting tank 60.

Particularly catchy, the two figures also show that a main extension plane H2 extends essentially parallel along the longitudinal direction L60 of the collecting vessel 60 and that the main radiation direction H10 of nozzle 1 projects away from the main extension plane H2 in at least one directional component. The other thing is that the receiver 60 selected in the figures is a beer mug with a hole in the bottom, so that the fluid, for example a beer, can be returned from the beer mug to the receiver 60. This achieves a completely closed liquid circuit.

In particular, a length L1 and/or the main radiation direction H10 of nozzle 1 is dimensioned in such a way that, after exiting nozzle 1, the fluid falls into the collection ratio 60 below nozzle 1 solely by the action of gravity and without ductwork.

Regarding the nozzle device 100 described above, it should be noted that the nozzle device 100 comprises at least one nozzle 1, in particular an elongated nozzle 1, for the directed radiation of the fountain fluid, the nozzle 1 having a main direction of extension H1, so that the fountain fluid can be removed substantially parallel to this main direction of extension H1 along a main direction of radiation H10.

In addition, the nozzle device described here comprises 100 at least one nozzle carrier 2, on which the nozzle 1 is arranged detachably or inseparably, the nozzle carrier 2 forming a nozzle carrier main extension plane H2 and wherein at least the main abstraction direction H10 of the nozzle 1 leads away from the nozzle carrier main extension plane H2 in at least one directional component.

In the present embodiment example, nozzle carrier 2 has a circular shape. The entire nozzle carrier 2 is located in the main nozzle carrier plane H2 and is formed by a fluid line 20.

In particular, the figures also show an elongated nozzle holder 12 of nozzle 1 and a nozzle head 13 which can be detached or inseparably arranged on a free end of nozzle holder 12. For example, the nozzle head 13 is also formed by one end of the nozzle holder 12 itself. It is also conceivable that the nozzle head 13 and the nozzle holder 12 are formed with a one-piece pipe element.

REFERENCES

1 nozzle
2 Nozzle carrier
12 Nozzle holder
13 Nozzle head
20 Fluid line
50 Fluid container
60 Collecting container
100 Nozzle equipment
1000 Fountains
1000A Fluid pump
1000B pipe for conveying the fluid
H1 Main stretch direction
H2 Nozzle carrier main extension plane
H10 Main beam direction
L1 Length
L60 Longitudinal direction

The invention claimed is:

1. A closed liquid circuit fountain, comprising
a fluid container configured to contain a fountain fluid;
a nozzle carrier arranged to form a main extension plane, the nozzle carrier being a fluid line configured to receive and direct a flow of the fountain fluid;
at least one line for conveying the fountain fluid from the fluid container to the nozzle carrier;
at least one fluid pump for conveying the fountain fluid from the fluid container through the at least one line and to the nozzle carrier;
a plurality of nozzles arranged on the nozzle carrier and being configured for directed radiation of the fountain fluid received via the nozzle carrier; and
a collecting vessel fluidly coupled with the fluid container, the collecting vessel being configured to receive the fountain fluid radiated from the plurality of nozzles, the main extension plane of the nozzle carrier being parallel to a longitudinal axis of the collecting vessel,
wherein the plurality of nozzles are laterally offset relative to a longitudinal axis of the collecting vessel, each of the nozzles having a main extension direction transverse to the main extension plane, so that the fountain fluid can be directed from each of the nozzles in a direction substantially parallel to the main extension direction along a main distribution direction,
wherein the plurality of nozzles are configured to direct the fountain fluid into the collecting vessel so that the closed liquid circuit is generated, and
wherein the collecting vessel is a mug with a handle.

2. The fountain according to claim 1, wherein
at least one of the nozzles is arranged at a lateral offset relative to a longitudinal direction of the collecting vessel.

3. The fountain according to claim 2, wherein
the nozzle carrier main extension plane extends substantially parallel to the longitudinal direction of the collecting vessel, and the main radiation direction of the nozzle extends away from the nozzle carrier main extension plane in at least one directional component.

4. The fountain according to claim 1, wherein
the collecting vessel is fixed interchangeably in an anchorage of the fluid container.

5. The fountain according to claim 1, wherein
at least one of the nozzles has such a main radiation direction in which at least one directional component points inwards in the direction of a geometric centre of the nozzle carrier.

6. The fountain according to claim 1, wherein
a length and/or the main radiation direction of the nozzles is dimensioned such that, after exiting each of the nozzles, the fluid falls, solely by the action of gravity and without ducting, into the collecting vessel arranged below the nozzles.

7. The fountain according to claim 1, wherein the nozzle carrier is formed as a partial circle or a partial ellipse, and
wherein at least a first one of the plurality of nozzles is arranged along the nozzle carrier in a first direction from where the fountain fluid enters the nozzle carrier, and at least a second one of the plurality of nozzles is arranged along the nozzle carrier in a second direction from where the fountain fluid enters the nozzle carrier, the second direction being opposite to the first direction.

8. The fountain according to claim 1, wherein
the nozzle carrier fluid line is a bent and/or a straight-line fluid line, the nozzle carrier fluid line running at least in places in the nozzle carrier main extension plane in a circular, ellipsoidal and/or along at least one pipe edge.

9. The fountain according to claim 1, wherein the nozzle carrier is in one piece.

10. The fountain according to claim 1, wherein each of the nozzles comprises a nozzle holder, at the free end of which a nozzle head is arranged detachably or inseparably.

11. The fountain according to claim 1, wherein at least two of the nozzles are spaced apart from each other along the length of the nozzle carrier.

12. The fountain according to claim 1, wherein at least three of the nozzles are spaced apart from each other at the same or different distances along the course of the nozzle carrier.

13. The fountain according to claim 1, wherein at least one of the nozzles is inseparable from the nozzle carrier such that separation of the at least one nozzle from the nozzle carrier requires destruction of the at least one nozzle and/or the nozzle carrier.

* * * * *